US010150642B2

(12) United States Patent
Nakano et al.

(10) Patent No.: US 10,150,642 B2
(45) Date of Patent: Dec. 11, 2018

(54) BINDING DEVICE AND IMAGE FORMING SYSTEM

(71) Applicant: FUJI XEROX CO., LTD., Tokyo (JP)

(72) Inventors: Yoshinori Nakano, Kanagawa (JP); Yasuhiro Kusumoto, Kanagawa (JP); Emiko Shiraishi, Kanagawa (JP); Junichi Hirota, Kanagawa (JP); Hiroshi Hagiwara, Kanagawa (JP); Katsumi Harada, Kanagawa (JP); Kojiro Tsutsumi, Kanagawa (JP); Hiroaki Awano, Kanagawa (JP); Takuya Makita, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 74 days.

(21) Appl. No.: 15/250,982

(22) Filed: Aug. 30, 2016

(65) Prior Publication Data

US 2017/0283205 A1 Oct. 5, 2017

(30) Foreign Application Priority Data

Mar. 29, 2016 (JP) ..... 2016-066531

(51) Int. Cl.
*B65H 37/04* (2006.01)
*B31F 5/02* (2006.01)
*G03G 15/00* (2006.01)

(52) U.S. Cl.
CPC ..... *B65H 37/04* (2013.01); *B31F 5/02* (2013.01); *G03G 15/6541* (2013.01); (Continued)

(58) Field of Classification Search
CPC ..... G03G 15/6544; G03G 2215/00852; B31F 1/07; B31F 5/02; B31F 2201/0712; (Continued)

(56) References Cited

U.S. PATENT DOCUMENTS 1,150,805 A * 8/1915 Beran ..... B21D 1/06 101/23
3,323,983 A * 6/1967 Palmer ..... B31F 1/07 162/113

(Continued)

FOREIGN PATENT DOCUMENTS

JP 5080691 B2 11/2012
WO 2011/018897 A1 2/2011

*Primary Examiner* — Leslie A Nicholson, III
(74) *Attorney, Agent, or Firm* — Sughrue Mion, PLLC

(57) ABSTRACT

A binding device includes a first pushing member that includes protrusions along one direction and that pushes a recording-material bundle as a result of pushing the protrusions against one of surfaces of the recording-material bundle, the protrusions disposed side by side in a direction that intersects the one direction; and a second pushing member that includes protrusions along the one direction and that pushes the recording-material bundle as a result of pushing the protrusions against the other surface of the recording-material bundle, the protrusions disposed side by side in the direction that intersects the one direction, wherein, in at least one end portion in the one direction of each protrusion of at least one of the first pushing member and the second pushing member, a hollow is disposed in a top portion of each protrusion.

9 Claims, 9 Drawing Sheets

(52) U.S. Cl.
CPC ..... *G03G 15/6544* (2013.01); *B65H 2301/51616* (2013.01); *B65H 2801/27* (2013.01); *G03G 2215/00852* (2013.01)

(58) Field of Classification Search
CPC ..... B65H 37/07; B65H 2801/27; B65H 2301/51616; B65H 2301/53828; B65H 37/04
USPC ..... 270/58.07, 58.08; 493/390
See application file for complete search history.

(56) References Cited

U.S. PATENT DOCUMENTS

| | | | | |
|---|---|---|---|---|
| 8,657,596 | B2 * | 2/2014 | Lake | B29C 55/18 425/363 |
| 8,899,568 | B2 * | 12/2014 | Matsushita | B31F 5/02 270/58.07 |
| 8,983,362 | B2 * | 3/2015 | Nakamura | B65H 37/04 270/58.08 |
| 9,126,794 | B2 * | 9/2015 | Abe | G03G 15/6541 |
| 2016/0107409 | A1 * | 4/2016 | Kubo | B31F 1/07 412/33 |

* cited by examiner

BINDING DEVICE AND IMAGE FORMING SYSTEM

CROSS-REFERENCE TO RELATED APPLICATIONS

This application is based on and claims priority under 35 USC 119 from Japanese Patent Application No. 2016-066531 filed Mar. 29, 2016.

BACKGROUND

Technical Field

The present invention relates to a binding device and an image forming system.

SUMMARY

According to an aspect of the invention, there is provided a binding device including a first pushing member that includes protrusions along one direction and that pushes a recording-material bundle as a result of pushing the protrusions against one of surfaces of the recording-material bundle, the protrusions disposed side by side in a direction that intersects the one direction; and a second pushing member that includes protrusions along the one direction and that pushes the recording-material bundle as a result of pushing the protrusions against the other surface of the recording-material bundle, the protrusions disposed side by side in the direction that intersects the one direction, wherein, in at least one end portion in the one direction of each protrusion of at least one of the first pushing member and the second pushing member, a hollow is disposed in a top portion of each protrusion.

BRIEF DESCRIPTION OF THE DRAWINGS

An exemplary embodiment of the present invention will be described in detail based on the following figures, wherein.

DETAILED DESCRIPTION

An exemplary embodiment of the present invention is described in detail below with reference to the attached drawings.

Figure 1:
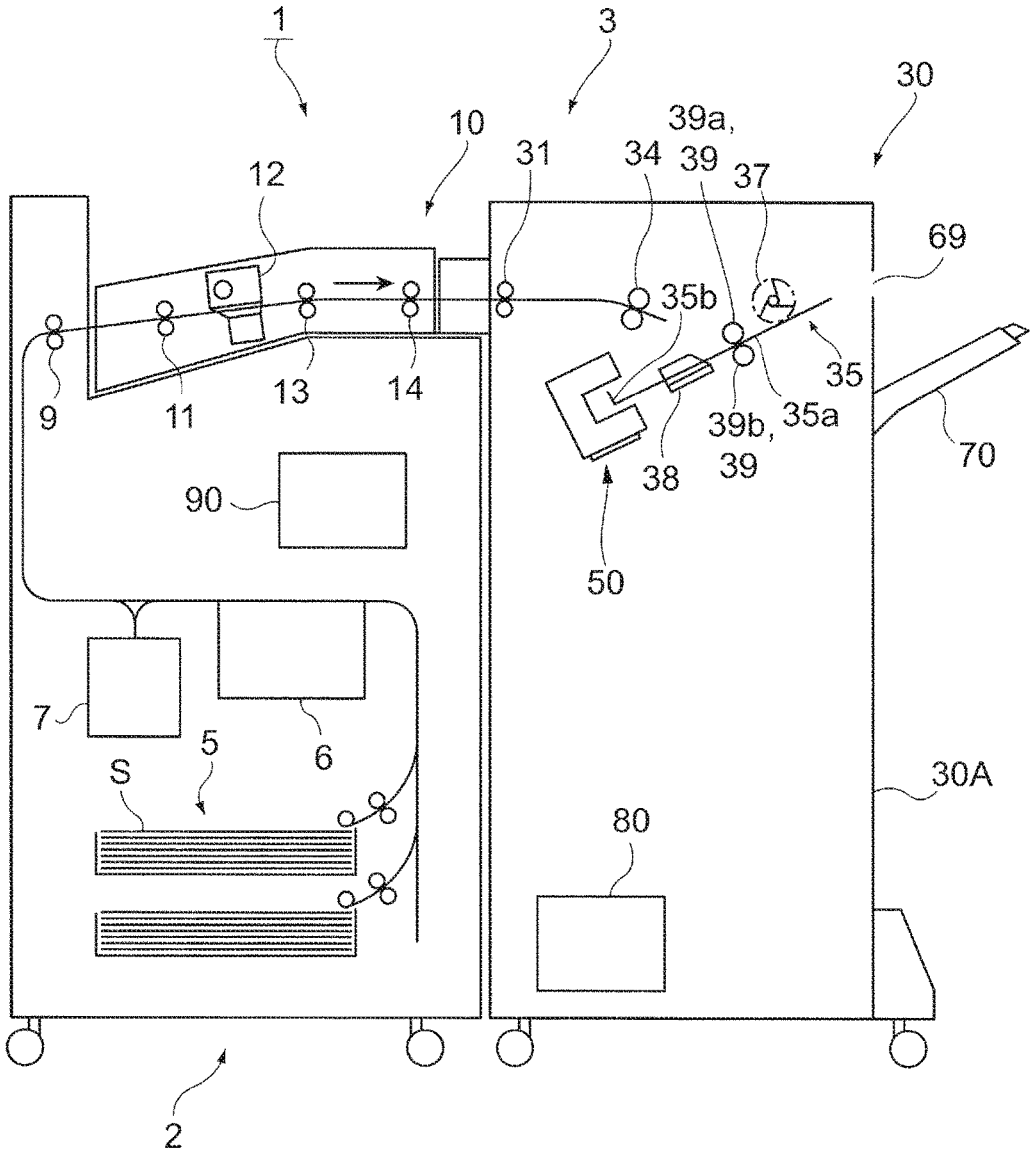
FIG. 1 illustrates an exemplary structure of an image forming system according to an exemplary embodiment.

FIG. 1 illustrates an exemplary structure of an image forming system 1 according to the exemplary embodiment.

The image forming system 1 shown in FIG. 1 includes, for example, an image forming apparatus 2, such as a printer or a copying machine, that forms an image by an electrophotographic system; and a sheet processing apparatus 3 that performs post-processing operations on sheets S, which are exemplary recording materials, on which, for example, toner images have been formed by the image forming apparatus 2.

The image forming apparatus 2 includes a sheet supplying unit 5 that supplies sheets S on which images are formed, and an image forming unit 6 that forms the images on the sheets S supplied from the sheet supplying unit 5.

The image forming apparatus 2 also includes a sheet reversing device 7 that reverses a side of a sheet S on which an image has been formed by the image forming unit 6, and discharge rollers 9 that discharge the sheet S on which the image has been formed.

The image forming apparatus 2 further includes a user interface 90 that receives binding information from a user.

The sheet processing apparatus 3 includes a transporting device 10 that transports a sheet S output from the image forming apparatus 2 further downstream, and a post-processing device 30.

The sheet processing apparatus 3 also includes a controller 80 that controls the entire image forming system 1.

The transporting device 10 includes a pair of entrance rollers, and a puncher 12. The entrance rollers 11 receive a sheet S output via the discharge rollers 9 of the image forming apparatus 2. When necessary, the puncher 12 punches holes in the sheet S received from the entrance rollers 11.

Further downstream from the puncher 12, the transporting device 10 includes a pair of first transport rollers 13 that transport the sheet S towards a downstream side; and a pair of second transport rollers 14 that transport the sheet S towards the post-processing device 30.

The post-processing device 30 includes a pair of receiving rollers 31 that receive the sheet S from the transporting device 10.

The post-processing device 30 also includes a compiling stacking unit 35 and a pair of exit rollers 34. The compiling stacking unit 35 is disposed downstream from the receiving rollers 31 and gathers and accommodates multiple sheets S. The exit rollers 34 discharge the sheets S towards the compiling stacking unit 35.

The post-processing device 30 further includes a paddle 37 that rotates so as to push in the sheet S towards an end guide 35*b* (described below) of the compiling stacking unit 35, a tamper 38 for aligning end portions of the sheets S, and eject rollers 39. The eject rollers 39 hold the sheets S accumulated on the compiling stacking unit 35, and rotate to transport a sheet bundle, which is an exemplary bound recording material bundle.

The post-processing device 30 further includes a needle-free binding device 50 that binds the end portions of the sheet bundle on the compiling stacking unit 35. In the exemplary embodiment, the needle-free binding device 50 is disposed at one end portion side of the compiling stacking unit 35 in a longitudinal direction thereof (that is, a side where the end guide 35*b* (described later) is provided).

The post-processing device 30 further includes a housing 30A that accommodates each of the above-described structural members therein. The housing 30A has an opening portion 69. The opening portion 69 is provided for discharging the sheet bundle bound by the needle-free binding device 50 to the outside of the post-processing device 30 by the eject rollers 39.

The post-processing device 30 further includes a stack unit 70 on which the sheet bundle discharged from the opening portion 69 of the housing 30A is stacked so as to allow a user to easily take the sheet bundle.

The compiling stacking unit 35 includes a bottom portion 35*a* having an upper surface on which sheets S are stacked. The bottom portion 35*a* is inclined so as to allow the sheets S to move along the upper surface thereof. The sheets S that are transported towards the compiling stacking unit 35 by the exit rollers 34 are stacked on the bottom portion 35*a*.

The compiling stacking unit 35 includes the end guide 35*b*. The end guide 35*b* aligns front end portions, in the direction of travel of sheets S, of the sheets S that move along the bottom portion 35*a*.

The paddle 37 is disposed above the compiling stacking unit 35.

By rotating the paddle 37, the sheets S that have been transported to the compiling stacking unit 35 and that are on the compiling stacking unit 35 are pushed against the side where the end guide 35*b* is provided.

The tamper 38 is provided on one end portion side and the other end portion side of the compiling stacking unit 35 in a width direction (that is, in a direction that intersects a transport direction of the sheets S in FIG. 1). The tamper 38 is disposed on both sides of the compiling stacking unit 35. When the tamper 38 is subjected to driving power of a motor (not shown) or the like, the tamper 38 moves in the width direction of the compiling stacking unit 35. Then, the tamper 38 aligns one end portions and the other end portions of the sheets S on the compiling stacking unit 35 (that is, the one end portions and the other end portions in the width direction of the compiling stacking unit 35).

The eject rollers 39 include a first eject roller 39*a* and a second eject roller 39*b*.

The first eject roller 39*a* and the second eject roller 39*b* are disposed so as to oppose each other with the bottom portion 35*a* of the compiling stacking unit 35 interposed therebetween.

The first eject roller 39*a* is provided on a front side of the compiling stacking unit 35 (that is, on a side where sheets S are stacked).

The second eject roller 39*b* is provided on a back side of the compiling stacking unit 35 (that is, on a side that is the reverse of the side where sheets S are stacked).

The first eject roller 39*a* and the second eject roller 39*b* in contact with the sheets S are subjected to driving power of a motor or the like, and rotate. The sheet bundle is transported to a side where the paddle 37 is provided.

Figure 2:
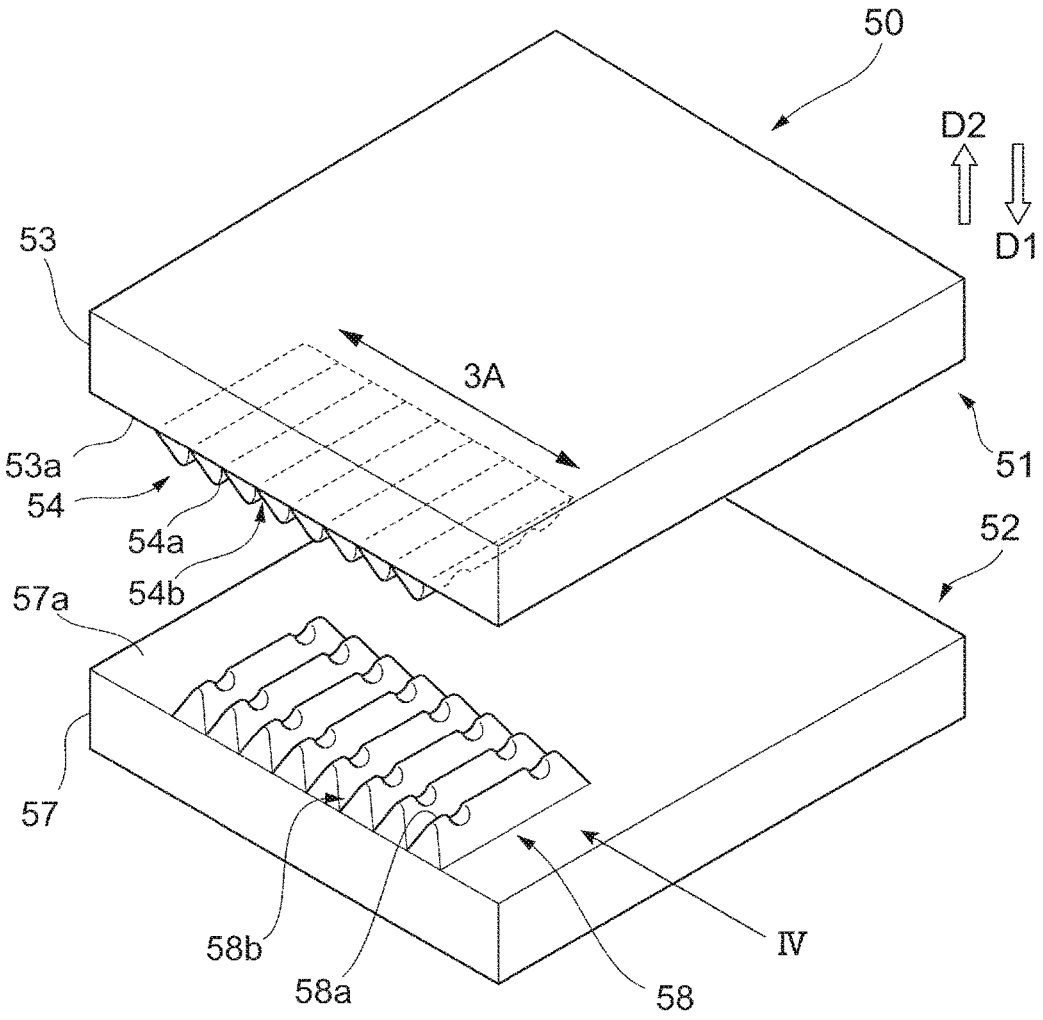
FIG. 2 is a perspective view of a structure of a needle-free binding device.
Figure 3:
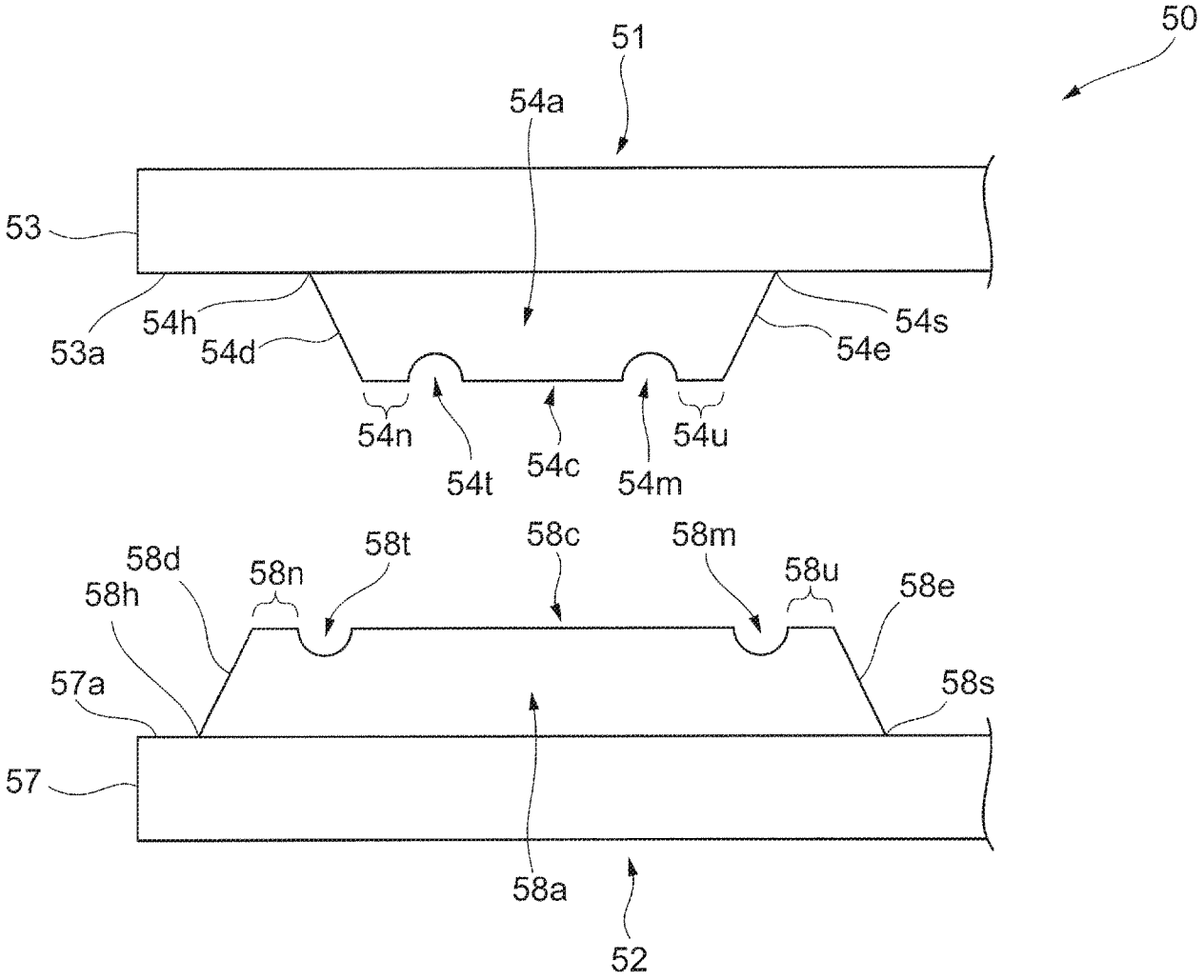
FIG. 3 illustrates a case in which the needle-free binding device is viewed from the direction of arrow IV in FIG. 2.

FIG. 2 is a perspective view of a structure of the needle-free binding device 50. FIG. 3 illustrates a case in which the needle-free binding device 50 is viewed from the direction of arrow IV in FIG. 2.

As shown in FIG. 2, the needle-free binding device 50 includes an upper pushing member 51 and a lower pushing member 52 that form a pair of pushing members. The lower pushing member 52 opposes the upper pushing member 51.

As a cam (not shown) that is subjected to driving power of a motor (not shown) is rotated, the upper pushing member 51 moves towards and away from the lower pushing member 52 (refer to arrows D1 and D2 in FIG. 2).

The upper pushing member 51 includes an upper base portion 53 and an upper uneven portion 54 that protrudes from the upper base portion 53. The upper uneven portion 54 extends along a direction (that is, in a direction of a double-headed arrow 3A in FIG. 2).

The upper uneven portion 54 includes multiple upper protrusions 54*a* and multiple upper recesses 54*b*.

The upper protrusions 54*a* are disposed side by side in a longitudinal direction of the upper uneven portion 54.

The upper protrusions 54*a* protrude downward from a surface 53*a* of the upper base portion 53. The upper protrusions 54*a* are formed along a lateral direction of the upper uneven portion 54 (that is, in a direction that intersects the longitudinal direction of the upper uneven portion 54).

The upper recesses 54*b* are formed between two upper protrusions 54*a* that are adjacent to each other in the longitudinal direction of the upper uneven portion 54. That is to say, the upper protrusions 54*a* and the upper recesses 54*b* are alternately disposed in the longitudinal direction of the upper uneven portion 54.

The lower pushing member 52 includes a lower base portion 57 and a lower uneven portion 58 that protrudes from the lower base portion 57. The lower uneven portion 58 extends along the longitudinal direction of the upper uneven portion 54.

The lower uneven portion 58 includes multiple lower protrusions 58*a* and multiple lower recesses 58*b*.

The upper protrusions 54*a* and the lower protrusions 58*a* are exemplary protrusions. The upper recesses 54*b* and the lower recesses 58*b* are exemplary trough portions.

The lower protrusions 58*a* are disposed side by side in a longitudinal direction of the lower uneven portion 58.

The lower protrusions 58*a* protrude upward from a surface 57*a* of the lower base portion 57. The lower protrusions 58*a* are formed along a lateral direction of the lower uneven portion 58 (that is, in a direction that intersects the longitudinal direction of the lower uneven portion 58).

The lower recesses 58*b* are formed between two lower protrusions 58*a* that are adjacent to each other in the longitudinal direction of the lower uneven portion 58. That is to say, the lower protrusions 58*a* and the lower recesses 58*b* are alternately disposed in the longitudinal direction of the lower uneven portion 58.

When the upper uneven portion 54 of the upper pushing member 51 engages with the lower uneven portion 58 of the lower pushing member 52 with the sheet bundle interposed therebetween, the sheet bundle is pushed, and an uneven portion is formed in the sheet bundle.

By this, each sheet S of the sheet bundle (that is, the sheets S that are adjacent to each other in the sheet bundle) are bound to each other.

Referring to FIG. 3, each upper protrusion 54*a* of the upper pushing member 51 has an upper top portion 54*c* at a lower end portion side in FIG. 3.

Each upper top portion 54*c* has an upper left hollow 54*t* in one end portion side of the upper top portion 54*c* in a longitudinal direction of the upper protrusion 54*a* so as to extend upward in FIG. 3.

An upper-left-top-portion edge 54*n* is formed closer to the one end portion side of each upper top portion 54*c* in the longitudinal direction of the corresponding upper protrusion 54*a* than the corresponding upper left hollow 54*t*.

Each upper right hollow 54*m* that extends upward in FIG. 3 is formed in the other end portion side of the corresponding upper top portion 54*c* in the longitudinal direction of the upper protrusion 54*a*.

An upper-right-top-portion edge 54*u* is formed closer to the other end portion side of each upper top portion 54*c* in the longitudinal direction of the corresponding upper protrusion 54*a* than the corresponding upper right hollow 54*m*.

Each upper left side wall 54*d* is formed at one end portion side of its corresponding upper protrusion 54*a* in the longitudinal direction of the corresponding upper protrusion 54*a*.

A lower-end-portion side of each upper left side wall 54*d* in FIG. 3 is connected to the upper top portion 54*c* of the corresponding upper protrusion 54*a*. An upper-end-portion side of each upper left side wall 54*d* in FIG. 3 is connected to the surface 53*a* of the upper base portion 53.

With increasing distance from the surface 53*a* of the upper base portion 53, each upper left side wall 54*d* is inclined towards a central portion side of the corresponding upper protrusion 54*a* in the longitudinal direction thereof. In other words, a side surface at the one end portion side of each upper protrusion 54*a* in the longitudinal direction thereof is inclined so as to widen towards the surface 53*a* of the upper base portion 53 from the corresponding upper top portion 54*c*.

An upper right side wall 54*e* is provided at the other end portion side of the corresponding upper protrusion 54*a* in the longitudinal direction of the corresponding upper protrusion 54*a*.

A lower end portion side of each upper right side wall 54*e* in FIG. 3 is connected to the corresponding upper top portion 54*c*. An upper end portion of each upper right side wall 54*e* in FIG. 3 is connected to the surface 53*a* of the upper base portion 53.

With increasing distance from the surface 53*a* of the upper base portion 53, each upper right side wall 54*e* is inclined towards the central portion side of the corresponding upper protrusion 54*a* in the longitudinal direction thereof. In other words, a side surface at the other end portion side of each upper protrusion 54*a* in the longitudinal direction thereof is inclined so as to widen towards the surface 53*a* of the upper base portion 53 from the corresponding upper top portion 54*c*.

Each upper-left-base-portion-side intersecting portion 54*h* is provided at one end portion side of the upper pushing member 51 in the longitudinal direction of the corresponding upper protrusion 54*a*. Each upper-left-base-portion-side intersecting portion 54*h* is positioned at a location where the corresponding upper left side wall 54*d* and the surface 53*a* of the upper base portion 53 intersect each other.

Each upper-right-base-portion-side intersecting portion 54*s* is provided at the other end portion side of the corresponding upper pushing member 51 in the longitudinal direction of the corresponding upper protrusion 54*a*. Each upper-right-base-portion-side intersecting portion 54*s* is positioned at a location where the corresponding upper right side wall 54*e* and the surface 53*a* of the upper base portion 53 intersect each other.

Next, the lower pushing member 52 is described.

Each lower protrusion 58*a* of the lower pushing member 52 is longer than its corresponding upper protrusion 54*a* in the longitudinal direction of the upper protrusion 54*a*.

The structure of the lower pushing member 52 is similar to the structure of the upper pushing member 51.

More specifically, each lower protrusion 58*a* has a lower top portion 58*c*, a lower left side wall 58*d*, and a lower right side wall 58*e*.

Each lower top portion 58*c* has an lower left hollow 58*t* in one end portion side of the lower top portion 58*c* in a longitudinal direction of the corresponding lower protrusion 58*a*, and a lower right hollow 58*m* in the other end portion side of the lower top portion 58*c* in the longitudinal direction of the corresponding lower protrusion 58*a*. Each lower left hollow 58*t* and each lower right hollow 58*m* are recessed downward with reference to FIG. 3.

A lower-left-top-portion edge 58*n* is formed closer to the one end portion side of each lower top portion 58*c* in the longitudinal direction of the corresponding lower protrusion 58*a* than the corresponding lower left hollow 58*t*.

A lower-right-top-portion edge 58*u* is formed closer to the other end portion side of each lower top portion 58*c* in the longitudinal direction of the corresponding lower protrusion 58*a* than the corresponding lower right hollow 58*m*.

With increasing distance from the surface 57*a* of the lower base portion 57, each upper left side wall 58*d* and the corresponding lower right side wall 58*e* are inclined towards a central portion side of the corresponding lower protrusion 58*a* in the longitudinal direction thereof.

The lower pushing member 52 has a lower-left-base-portion-side intersecting portion 58*h* and a lower-right-base-portion-side intersecting portion 58*s*.

In the exemplary embodiment, in the longitudinal direction of each upper protrusion 54*a*, the position of each upper-left-base-portion-side intersecting portion 54*h* (that is, the position thereof in the longitudinal direction of the corresponding upper protrusion 54*a*) and the position of a region where the corresponding lower left hollow 58*t* is formed (that is, the position thereof in the longitudinal direction of the corresponding upper protrusion 54*a*) are aligned with each other.

In addition, in the longitudinal direction of each upper protrusion 54*a*, the position of each upper-right-base-portion-side intersecting portion 54*s* and the position of a region where the corresponding lower right hollow 58*m* is formed are aligned with each other.

Figure 4:
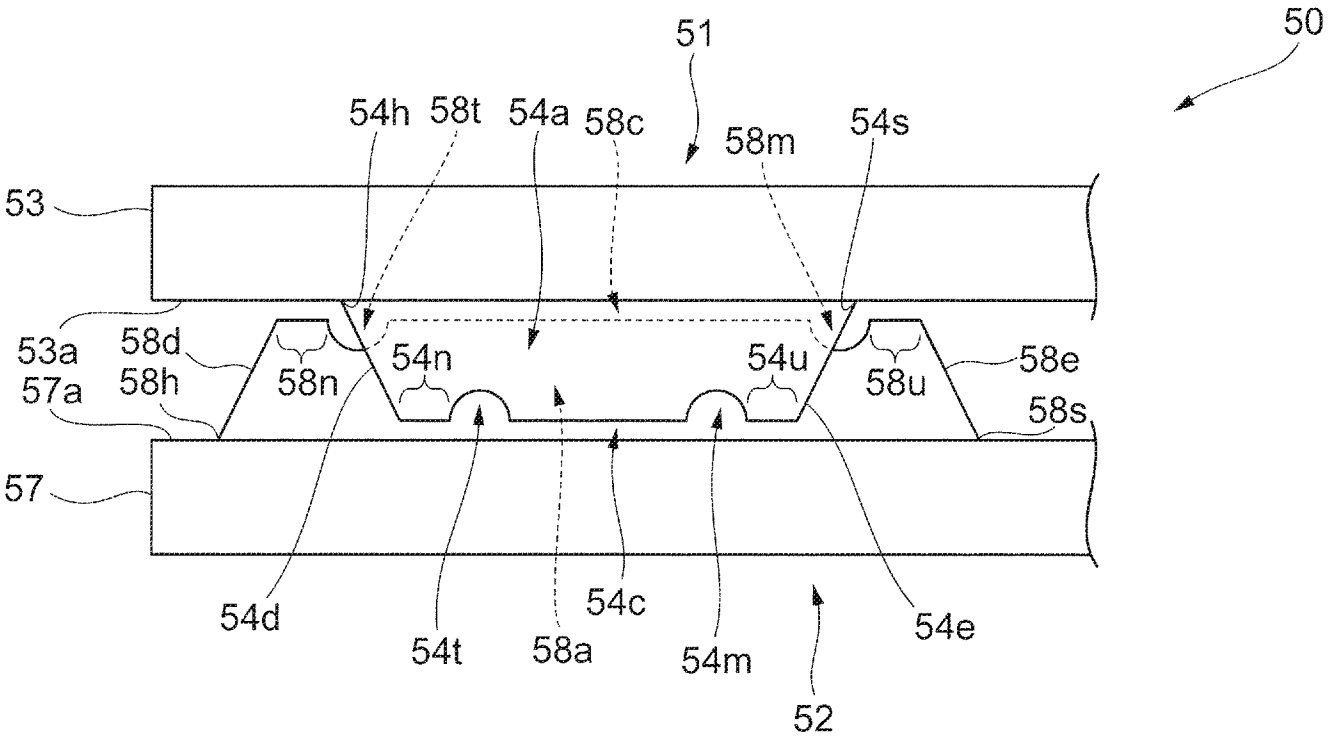
FIG. 4 illustrates a relationship between the position of an upper protrusion and the position of a lower protrusion during binding.

FIG. 4 illustrates a relationship between the position of an upper protrusion 54*a* and the position of a lower protrusion 58*a* during binding. In FIG. 4, a sheet bundle is not shown. In addition, in FIG. 4, the lower protrusion 58*a* is positioned at a farther side than the upper protrusion 54*a* in the plane of FIG. 4.

As shown in FIG. 4, the upper pushing member 51 moves downward towards the lower pushing member 52. When the upper pushing member 51 moves downward, a sheet bundle is pushed between the upper protrusion 54*a* and the lower protrusion 58*a*.

In the exemplary embodiment, as described above, each upper top portion 54*c* has the upper left hollow 54*t* and the upper right hollow 54*m*. Each lower top portion 58*c* has the lower left hollow 58*t* and the lower right hollow 58*m*.

A sheet bundle is not pushed at portions where the hollows (the upper left hollows 54*t*, the upper right hollows 54*m*, the lower left hollows 58*t*, and the lower right hollows 58*m*) are formed. In other words, the area of the upper protrusions 54*a* and the lower protrusions 58*a* that are pushed against the sheet bundle is reduced by the hollows.

In such a case, a load that acts upon the sheet bundle per unit area is increased.

In the exemplary embodiment, the hollows are formed in the one end portion side and the other end portion side of each upper vertex portion 54*c* and of each lower vertex portion 58*c*. Therefore, the sheet bundle may less likely be unbound.

In general, various external forces are generated on the sheet bundle after the sheet bundle has been bound. When such external forces are generated on the sheet bundle, first, the sheet bundle is unbound from corners of a bound portion of the sheet bundle, and the unbinding continues through the entire bound portion.

In the exemplary embodiment, each upper top portion 54*c* and each lower top portion 58*c* have a hollow in the one end portion side and a hollow in the other end portion side. In such a case, compared to a case in which hollows are not formed, a load concentrates on portions of the sheet bundle where the edges (that is, the upper-left-top-portion edge 54*n*, the upper-right-top-portion edge 54*u*, the lower-left-top-portion edge 58*n*, and the lower-right-top-portion edge 58*u*) push against the corresponding adjacent hollows.

By this, binding forces between the sheets S of the sheet bundle (that is, between the sheets S that are adjacent to each other in the sheet bundle) are increased at the corners of the bound portion (portion of the sheet bundle against which the edges are pushed). As a result, the sheet bundle may less likely be unbound.

In other words, although the sheet bundle starts to be unbound from the corners of the bound portion as mentioned above, in the exemplary embodiment, the binding forces between the sheets S at the corners are increased. This suppresses the separation of the sheets S from each other.

Figure 5:
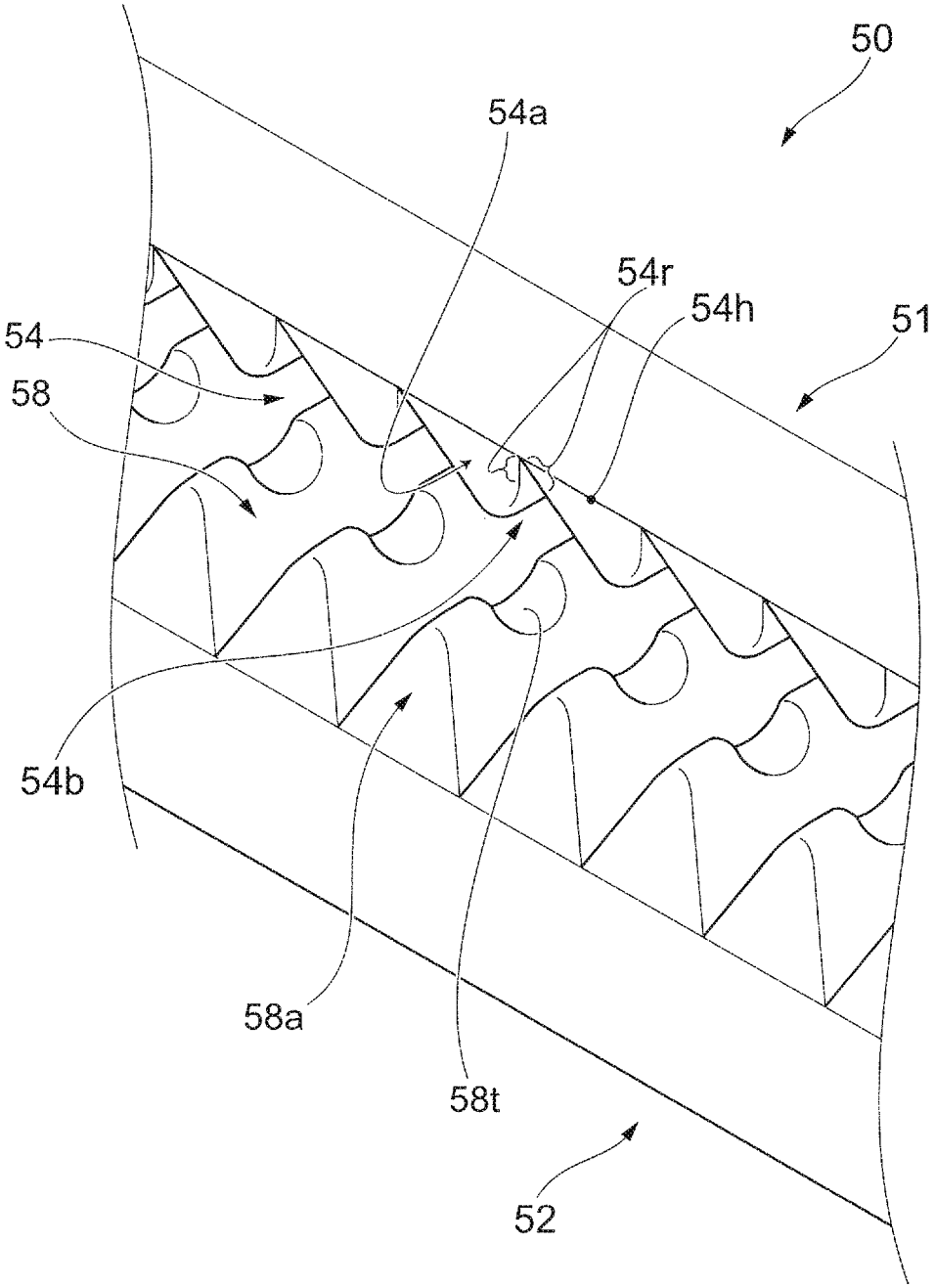
FIG. 5 illustrates a relationship between the position of each lower left hollow and each upper recess.

FIG. 5 illustrates a relationship between the position of each lower left hollow 58*t* and each upper recess 54*b*.

As shown in FIG. 5, an upper left trough bottom edge 54*r* is formed at one end portion side of each upper recess 54*b* in the longitudinal direction of the corresponding lower protrusion 58*a*.

In the exemplary embodiment, in the longitudinal direction of the lower protrusions 58*a*, the positions of the upper left trough bottom edges 54*r* are aligned with the positions of the regions where the lower left hollows 58*t* are formed. In other words, the upper left trough bottom edges 54*r* are positioned so as to oppose the regions where the corresponding lower left hollows 58*t* are formed.

Further, in the exemplary embodiment, in the longitudinal direction of the lower protrusions 58*a*, the positions of the upper-left-base-portion-side intersecting portions 54*h* (also refer to FIG. 4) and the positions of the upper left trough bottom edges 54*r* are aligned with each other. Therefore, in the longitudinal direction of the lower protrusions 58*a*, the positions of the upper-left-base-portion-side intersecting portions 54*h* and the positions of the lower left hollows 58*t* are also aligned with each other.

Here, in this structure, the sheet bundle is pushed against the upper left trough bottom edges 54*r* from below the upper left trough bottom edges 54*r*. When the sheet bundle is strongly pushed against this portion, the sheets S may be damaged.

In contrast, in the exemplary embodiment, the lower left hollows 58*t* are disposed so as to oppose the upper left trough bottom edges 54*r*. Therefore, in the exemplary embodiment, the sheet bundle moves towards the lower left hollows 58*t*, so that a push force of the sheet bundle against the upper left trough bottom edges 54*r* is reduced.

In particular, in the exemplary embodiment, since the lower left hollows 58*t* are formed, the area of contact between the sheet bundle and the lower pushing member 52 is reduced, so that a push load per unit area is increased. In such a case, when the sheet bundle is pushed against the upper left trough bottom edges 54*r*, for example, the sheets S tend to be damaged.

However, in the exemplary embodiment, as described above, the lower left hollows 58*t* are disposed so as to oppose the upper left trough bottom edges 54*r*. Consequently, the push force of the sheet bundle against the upper left trough bottom edges 54*r* is reduced.

The same applies to the other end portion side of each upper protrusion 54*a* in the longitudinal direction thereof. In the exemplary embodiment, trough bottom edges are positioned so as to oppose the lower right hollows 58*m* (see FIG. 4). As at the one end portion side, a push force of the sheet bundle against the trough bottom edges is reduced.

In the exemplary embodiment, as shown in FIG. 4, with increasing distance from the surface 53*a* of the upper base portion 53, each upper left side wall 54*d* and each upper right side wall 54*e* are inclined towards the central portion side of the corresponding upper protrusion 54*a* in the longitudinal direction thereof. Here, each upper left side wall 54*d* and each upper right side wall 54*e* may be formed so as to be orthogonal to the surface 53*a* of the upper base portion 53.

Similarly, each lower left side wall 58*d* and each lower right side wall 58*e* may be formed so as to be orthogonal to the surface 57*a* of the lower base portion 57.

Figure 6:
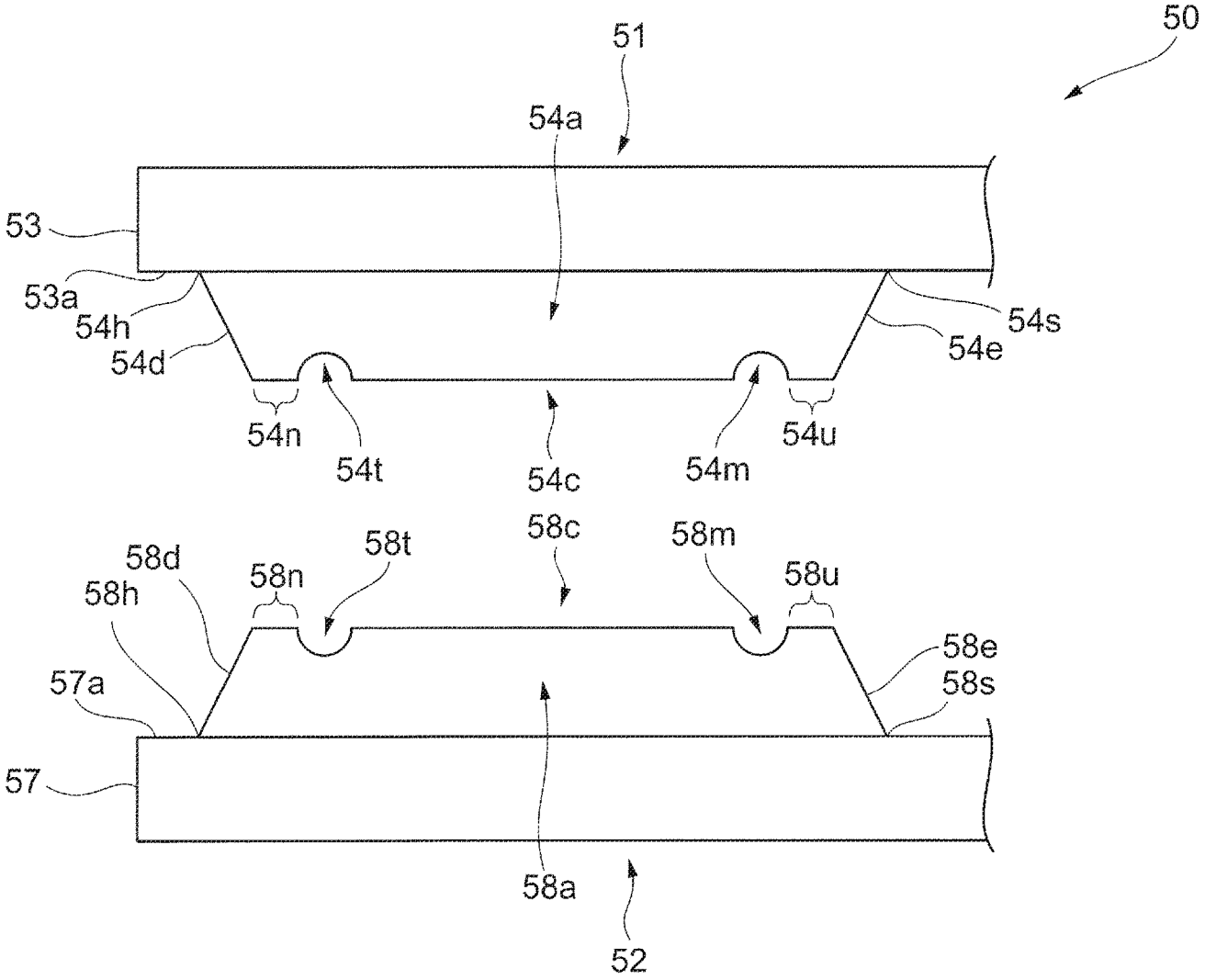
FIG. 6 illustrates another exemplary structure of the needle-free binding device.

FIG. 6 illustrates another exemplary structure of the needle-free binding device 50. Structural features having the same functions as those of the structural features shown in FIG. 3 are given the same reference numerals.

As shown in FIG. 6, in this exemplary structure, the length of each lower protrusion 58*a* in the longitudinal direction thereof is the same as the length of each upper protrusion 54*a* in the longitudinal direction thereof.

The positions of regions where the upper left hollows 54*t* are formed and the positions of regions where the lower left hollows 58*t* are formed are aligned with each other. Similarly, the positions of regions where the upper right hollows 54*m* are formed and the positions of regions where the lower right hollows 58*m* are formed are aligned with each other.

In addition, the positions of the upper-left-top portion edges 54*n* and the positions of the lower-left-top-portion edges 58*n* are aligned with each other. Similarly, the positions of the upper-right-top portion edges 54*u* and the positions of the lower-right-top-portion edges 58*u* are aligned with each other.

Even in this exemplary structure, a load tends to concentrate on portions of the sheet bundle pushed by the edges (that is, the upper-left-top-portion edges 54*n*, the upper-right-top-portion edges 54*u*, the lower-left-top-portion edges 58*n*, and the upper-right-top-portion edges 58*u*). By this, binding forces between the sheets S of the sheet bundle are increased at the corners of the bound portion. As a result, the sheet bundle may less likely be unbound.

Figure 7:
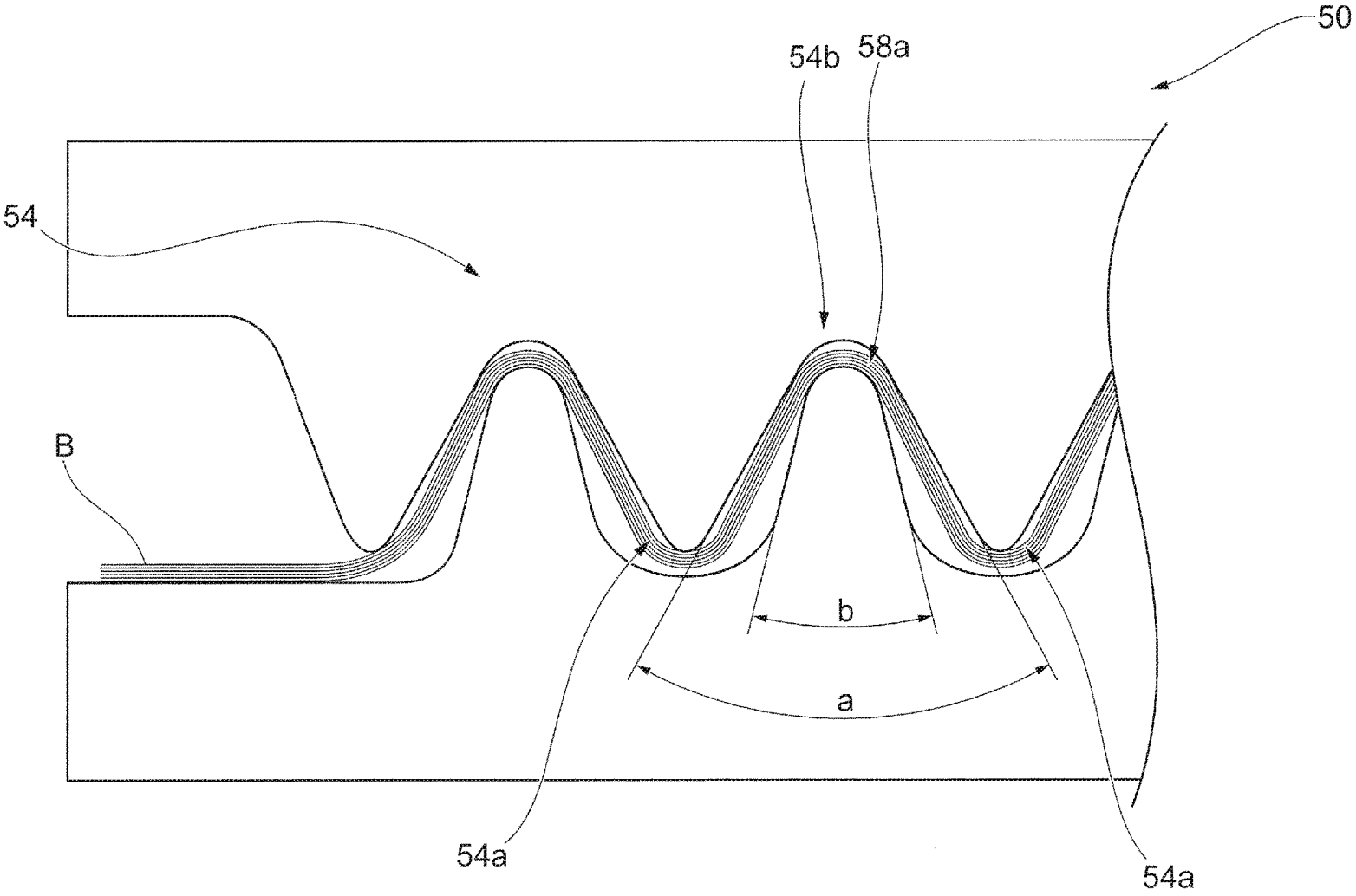
FIG. 7 illustrates still another exemplary structure of the needle-free binding device when the needle-free binding device is viewed from one end portion side in a lateral direction of an upper uneven portion.

FIG. 7 illustrates still another exemplary structure of the needle-free binding device 50 when the needle-free binding device 50 is viewed from the one end portion side in a lateral direction of the upper uneven portion 54. Structural features having the same functions as those of the structural features shown in FIGS. 2 and 3 are given the same reference numerals.

In the exemplary structure, an upper opening angle a of each upper recess 54*b* and a lower vertex angle b of each lower protrusion 58*a* satisfy the relationship of upper opening angle>lower vertex angle.

Here, the upper opening angle a is an angle that is formed by a side surface of an upper protrusion 54*a* and a side surface of another upper protrusion 54*a* that is adjacent to the upper protrusion 54*a*.

The lower vertex angle b is an angle that is formed by one side surface and the other side surface of a lower protrusion 58*a*.

In this exemplary structure, compared to a case in which the upper opening angle a and the lower vertex angle b are equal to each other, a load that acts upon a sheet bundle B per unit area is increased.

In this case, a load required for binding the sheet bundle B may be reduced.

Next, another exemplary structure of the upper pushing member 51 and the lower pushing member is described.

In the exemplary structure shown in FIG. 2, in the upper pushing member 51, the protrusions 54*a* protrude from the surface 53*a* of the base portion 53, and the recesses are formed between the protrusions; and in the lower pushing member 52, the protrusions 58*a* protrude from the surface 57*a* of the base portion 57, and the recesses are formed between the protrusions.

Here, as described with reference to FIGS. 8 and 9 below, the recesses may be formed so as to be recessed in the surface of the corresponding base portion. Although not shown in FIGS. 8 and 9, hollows are formed in one end portion and the other end portion of each upper protrusion 54*a* and in one end portion and the other end portion of each lower protrusion 58*a* in the longitudinal direction thereof as in the description above.

Figure 8:
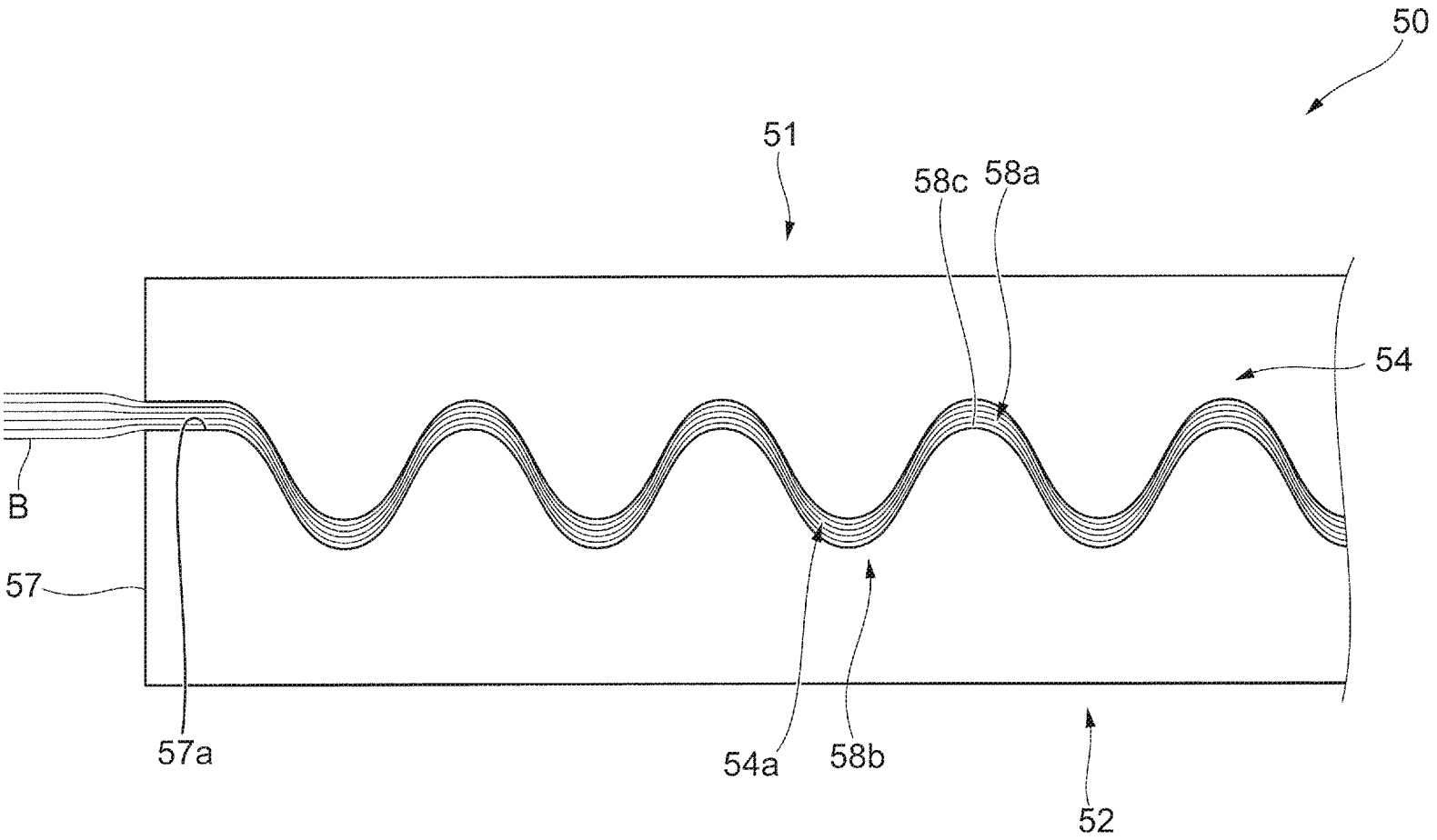
FIG. 8 illustrates still another exemplary structure of the needle-free binding device when the needle-free binding device is viewed from the one end portion side in the lateral direction of the upper uneven portion.

FIG. 8 illustrates still another exemplary structure of the needle-free binding device 50 when the needle-free binding device 50 is viewed from the one end portion side in the lateral direction of the upper uneven portion 54. Structural features having the same functions as those of the structural features shown in FIGS. 2 and 3 are given the same reference numerals.

In this exemplary structure, each lower recess 58*b* is formed so as to be recessed downward in FIG. 8 from the surface 57*a* of the lower base portion 57.

The positions of the lower top portions 58*c* of the lower protrusions 58*a* are aligned with the position of the surface 57*a* of the lower base portion 57 in an up-down direction in FIG. 8.

In the exemplary embodiment shown in FIG. 2, the lower protrusions 58*a* protrude from the surface 57*a* of the lower base portion 57, and the lower recesses 58*b* are positioned between the lower protrusions 58*a*. However, as shown in FIG. 8, the lower recesses 58*b* may be formed so as to be recessed from the surface 57*a* of the lower base portion 57. Further, the lower protrusions 58*a* may be provided below the surface 57*a* of the lower base portion 57.

Figure 9:
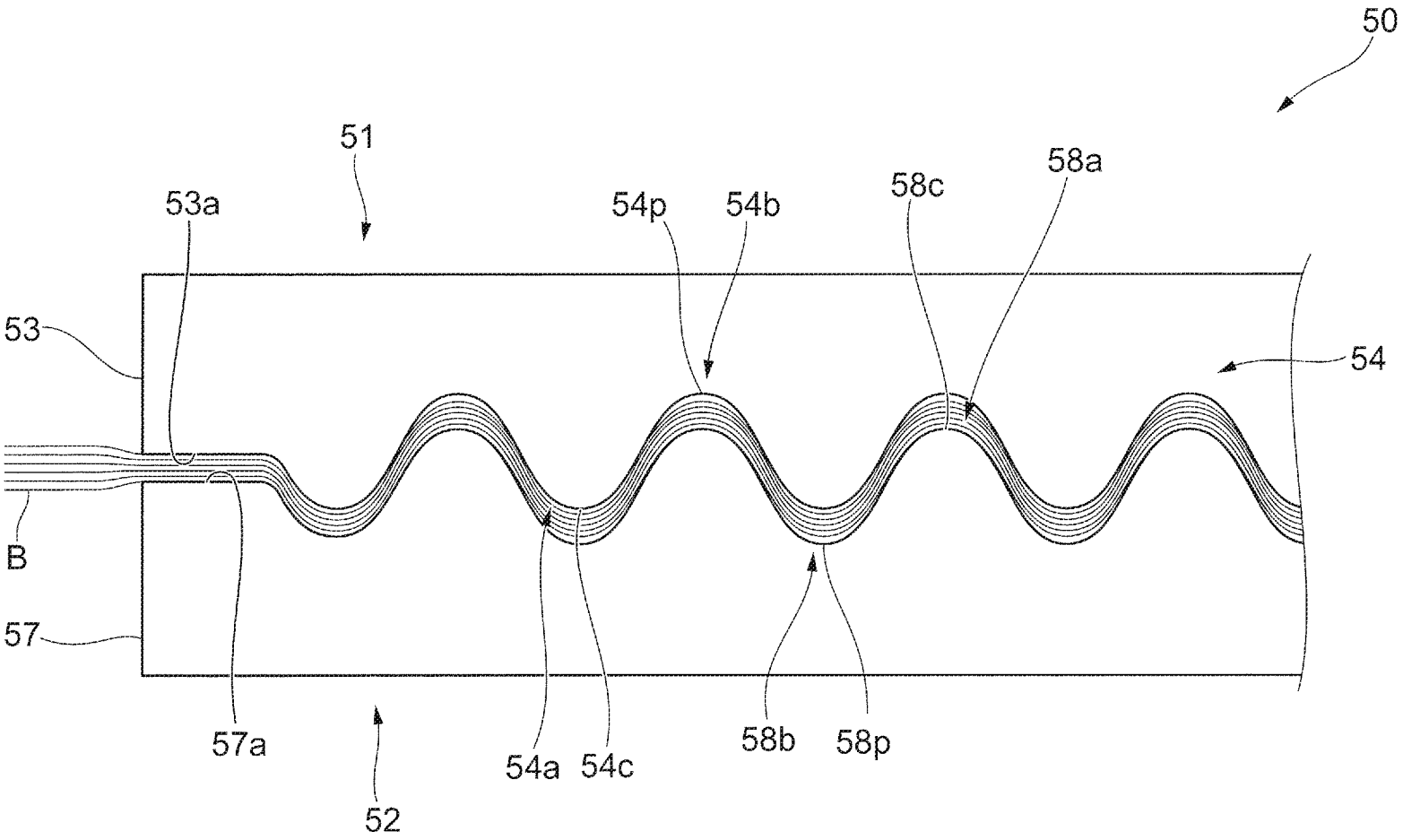
FIG. 9 illustrates still another exemplary structure of the needle-free binding device when the needle-free binding device is viewed from the one end portion side in the lateral direction of the upper uneven portion.

FIG. 9 illustrates still another exemplary structure of the needle-free binding device 50 when the needle-free binding device 50 is viewed from the one end portion side in the lateral direction of the upper uneven portion 54. Structural features having the same functions as those of the structural features shown in FIGS. 2 and 3 are given the same reference numerals.

In this exemplary structure, the surface 53*a* of the upper base portion 53 is positioned between the upper top portions 54*c* and bottom portions 54*p* of the upper recesses 54*b* in the up-down direction in FIG. 9.

The same applies to the lower pushing member 52. The surface 57*a* of the lower base portion 57 is positioned between the lower vertex portions 58*c* and bottom portions 58*p* of the lower recesses 58*b* in the up-down direction in FIG. 9.

In the exemplary embodiment shown in FIG. 2, the position of the surface of each base portion and the position of the bottom portions of the recesses are aligned with each other. However, in the exemplary structure shown in FIG. 9, the surface of each base portion is positioned between the top portions of the protrusions and the bottom portions of the recesses.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A binding device comprising:

a first pushing member that includes a plurality of protrusions along one direction and that is configured to push a recording-material bundle as a result of pushing the plurality of protrusions against one of surfaces of the recording-material bundle, the plurality of protrusions disposed side by side in a direction that intersects the one direction; and a second pushing member that includes a plurality of protrusions along the one direction and that is configured to push the recording-material bundle as a result of pushing the plurality of protrusions against the other surface of the recording-material bundle, the plurality of protrusions disposed side by side in the direction that intersects the one direction, wherein, in at least one end portion in the one direction of each protrusion of at least one of the first pushing member and the second pushing member, a hollow is disposed in a top portion of each protrusion, and wherein, in a center portion in the one direction of each protrusion of at least one of the first pushing member and the second pushing member, no hollows are disposed in a top portion of each protrusion.

2. The binding device according to claim 1, wherein the first pushing member and the second pushing member each include a base portion and a trough portion, the protrusions of the first pushing member protruding from a surface of the base portion of the first pushing member, the protrusions of the second pushing member protruding from a surface of the base portion of the second pushing member, the trough portion of the first pushing member being provided between the protrusions of the first pushing member that are adjacent to each other, the trough portion of the second pushing member being provided between the protrusions of the second pushing member that are adjacent to each other, and wherein, in each of the first pushing member and the second pushing member, in a direction in which the protrusions protrude, the surface of the base portion is positioned between the top portions of the protrusions and a bottom of the trough portion.

3. The binding device according to claim 1, wherein a vertex angle of each protrusion of the at least one of the first pushing member and the second pushing member is less than an opening angle of a trough portion positioned between the protrusions of the other of the first pushing member and the second pushing member.

4. An image forming system comprising:

an image forming unit configured to form images on recording materials; and the binding device according to claim 1 wherein the binding device is configured to bind the plurality of the recording materials on which the images are formed by the image forming unit.

5. The binding device according to claim 1, wherein in both of the first pushing member and the second pushing member hollows are disposed in a top portion of each protrusion, and wherein the hollows of the first pushing member and the hollows of the second pushing member are disposed in same portion in the one direction.

6. The binding device according to claim 1, wherein in both of the first pushing member and the second pushing member hollows are disposed in a top portion of each protrusion, and wherein the hollows of the first pushing member and the hollows of the second pushing member are disposed in same portion in the one direction.

7. A binding device comprising:

a first pushing member that includes a plurality of protrusions along one direction and that is configured to push a recording-material bundle as a result of pushing the plurality of protrusions against one of surfaces of the recording-material bundle, the plurality of protrusions disposed side by side in a direction that intersects the one direction; and a second pushing member that includes a plurality of protrusions along the one direction and that is configured to push the recording-material bundle as a result of pushing the plurality of protrusions against the other surface of the recording-material bundle, the plurality of protrusions disposed side by side in the direction that intersects the one direction, wherein, in at least one end portion in the one direction of each protrusion of at least one of the first pushing member and the second pushing member, a hollow is disposed in a top portion of each protrusion, wherein the first pushing member and the second pushing member each include a base portion, the protrusions of the first pushing member protruding from a surface of the base portion of the first pushing member, the protrusions of the second pushing member protruding from a surface of the base portion of the second pushing member, wherein at least one end portion in the one direction of each protrusion of the other of the first pushing member and the second pushing member includes a side wall that is connected to the surface of the base portion thereof, and a portion where the side wall and the surface of the base portion thereof are connected to each other includes an intersecting portion, and wherein a position in the one direction of the intersecting portion of the other of the first pushing member and the second pushing member and a position in the one direction of a region where the hollow of the one of the first pushing member and the second pushing member is formed are aligned with each other.

8. A binding device comprising:

a first pushing member that includes a plurality of protrusions along one direction and that is configured to push a recording-material bundle as a result of pushing the plurality of protrusions against one of surfaces of the recording-material bundle, the plurality of protrusions disposed side by side in a direction that intersects the one direction; and a second pushing member that includes a plurality of protrusions along the one direction and that is configured to push the recording-material bundle as a result of pushing the plurality of protrusions against the other surface of the recording-material bundle, the plurality of protrusions disposed side by side in the direction that intersects the one direction, wherein, in at least one of the first pushing member and the second pushing member, a hollow is disposed in a top portion of each protrusion, wherein the plurality of protrusions of the first pushing member engages with the plurality of protrusions of the second pushing member, and wherein the hollow does not engage with protrusions of the one of the first pushing member and the second pushing member in which the hollow is not disposed.

9. The binding device according to claim 8, wherein in both of the first pushing member and the second pushing member hollows are disposed in a top portion of each protrusion, and wherein the hollows of the first pushing member and the hollows of the second pushing member are disposed in same portion in the one direction.

* * * * *